US010772779B2

(12) United States Patent
Nilsson et al.

(10) Patent No.: US 10,772,779 B2
(45) Date of Patent: Sep. 15, 2020

(54) PATIENT REPOSITIONING SYSTEM

(71) Applicants: Arjo IP Holding AB, Malmo (SE); HUNTLEIGH TECHNOLOGY LIMITED, Dunstable (GB)

(72) Inventors: Richard Nilsson, Lund (SE); Andreas Thomasson, Sjobo (SE)

(73) Assignee: Arjo IP Holding AB, Malmo (SE)

( * ) Notice: Subject to any disclaimer, the term of this patent is extended or adjusted under 35 U.S.C. 154(b) by 0 days.

(21) Appl. No.: 14/423,248

(22) PCT Filed: Aug. 23, 2013

(86) PCT No.: PCT/GB2013/052226

§ 371 (c)(1),
(2) Date: Feb. 23, 2015

(87) PCT Pub. No.: WO2014/030010

PCT Pub. Date: Feb. 27, 2014

(65) Prior Publication Data

US 2015/0231010 A1 Aug. 20, 2015

(30) Foreign Application Priority Data

Aug. 23, 2012 (GB) ..... 1215012.4

(51) Int. Cl.
*A61G 7/10* (2006.01)
*A61G 7/053* (2006.01)

(52) U.S. Cl.
CPC ..... *A61G 7/1038* (2013.01); *A61G 7/053* (2013.01); *A61G 7/1023* (2013.01);
(Continued)

(58) Field of Classification Search
CPC .. A61G 7/0146; A61G 7/1019; A61G 7/1017; A61G 7/1051; A61G 7/1067;
(Continued)

(56) References Cited

U.S. PATENT DOCUMENTS 2,404,734 A * 7/1946 Lenahan ..... A61G 7/1019 5/81.1 R
5,001,789 A * 3/1991 Schoenberger ..... A61G 7/1017 5/87.1
(Continued)

FOREIGN PATENT DOCUMENTS

JP 10-179645 A 7/1998
JP 11-137615 A 5/1999
JP 2001-8979 A 1/2001

OTHER PUBLICATIONS

International Search Report and Written Opinion issued for corresponding International Application No. PCT/GB2013/052226, dated Nov. 14, 2013, 2 pages.

*Primary Examiner* — Peter M. Cuomo
*Assistant Examiner* — Morgan J McClure
(74) *Attorney, Agent, or Firm* — The Webb Law Firm

(57) ABSTRACT

A patient repositioning device includes an upper body support and a lower body support which are generally planar and laterally spaced from one another by a spacing element. A handle can rotate in the plane of the supports, enabling a care giver to rotate a patient form a sitting to a lying position and then to roll the patient onto their back. Another embodiment provides a patient cradle for cradling a patient from a reclining to a sitting position and vice versa.

22 Claims, 8 Drawing Sheets

(52) U.S. Cl.
CPC ..... *A61G 7/1086* (2013.01); *A61G 7/1096* (2013.01); *A61G 7/1017* (2013.01); *A61G 7/1049* (2013.01); *A61G 7/1051* (2013.01)

(58) Field of Classification Search
CPC .. A61G 7/1096; A61G 7/1048; A61G 7/1055; A61G 7/1011; A61G 7/1049; A61G 7/1038; A61G 7/1023; A61G 7/053; A61G 7/1086
See application file for complete search history.

(56) References Cited

U.S. PATENT DOCUMENTS 5,005,231 A * 4/1991 Lonardo ..... A61G 7/1023 5/81.1 T
5,090,072 A * 2/1992 Gray ..... A61G 7/1019 5/86.1
5,134,737 A * 8/1992 Wyman ..... A61G 5/00 5/185
5,319,813 A * 6/1994 DiMatteo ..... A61G 7/005 5/81.1 C
5,704,081 A * 1/1998 Bollinger ..... A61G 7/1026 5/81.1 T
5,758,371 A * 6/1998 VanDyke ..... A61G 7/1015 5/86.1
5,916,085 A * 6/1999 Wells ..... A61G 7/053 5/608
D413,285 S * 8/1999 Votel ..... D12/133
6,185,761 B1 * 2/2001 Chapman ..... A61G 7/1011 5/81.1 HS
6,938,285 B2 * 9/2005 Fernie ..... A61G 7/1017 5/81.1 R
7,032,265 B2 * 4/2006 Miller ..... A47C 21/00 5/658
D582,184 S * 12/2008 Bauer ..... D6/380
7,716,758 B2 * 5/2010 De Kruijf ..... A61G 7/053 5/600
8,336,133 B2 * 12/2012 Palay ..... A61G 5/14 5/81.1 R
8,402,575 B2 * 3/2013 Tanaka ..... A61G 7/103 5/81.1 HS
8,646,125 B2 * 2/2014 Stryker ..... A61G 7/10 254/124
8,661,579 B2 * 3/2014 Orrico ..... A61G 7/1038 297/325
2003/0093858 A1 * 5/2003 Maizel ..... A61G 5/10 5/81.1 R
2004/0019967 A1 * 2/2004 Gant ..... A61G 7/053 5/81.1 R
2005/0268397 A1 * 12/2005 Nativ ..... A61G 7/1015 5/86.1
2010/0154115 A1 * 6/2010 Wernqvist ..... A61G 7/1017 5/86.1

* cited by examiner

PATIENT REPOSITIONING SYSTEM

CROSS-REFERENCE TO RELATED APPLICATIONS

This application is a nationalization under 35 U.S.C. § 371 of PCT International Application No. PCT/GB2013/052226, filed Aug. 23, 2013 titled "PATIENT REPOSITIONING SYSTEM", which in turn claims the benefit of priority to Patent Application serial No. GB1215012.4 filed on Aug. 23, 2012, the entire contents of which are expressly incorporated by reference herein.

FIELD OF THE DISCLOSURE

The present invention relates to an apparatus and method to aid a care giver in changing posture of a person from sitting to lying at a bed and in particular to aid a caregiver in helping a person in and out from a bed or similar equipment.

BACKGROUND

When lying down in bed, the movement of getting the patient's legs up in bed is heavy. The patient may have big difficulties doing this by themselves due to reduced strength. If this manoeuvre is performed by the nurse, she or he is lifting the weight in a difficult height and position.

In particular, persons having mobility, strength or other limitations hindering them from coming from a sitting position to a lying position, or vice versa, on a bed will need help to perform this task. At settings where a carer helps to carry out this task daily, be it in a hospital, special care centre or a home and the carer being a nurse or another professional person or a relative to the person to be helped, this person will be exposed to a number of operations putting their health at risk, such as for example overload of the muscles and/or back. The reasons for the potential risks are several individual factors or combination of factors. For example a difference in length of the person to be helped and the carer will result in non-optimal working posture. Another factor is the difference in weight giving unequal load between the persons. Factors such as the working height might have severe effects on the carer since it affects the carer's reach and thus possibly making the carer twist their back to compensate. A low working height will lead to a bent back of the carer, resulting in very high loads on the lower back. Another factor affecting the reach comes from the width of the bed and the fact that the legs of the person to be helped legs have to come from the lying position relatively far in from the edge of the bed and out onto the edge of the bed for the carer to be able to help them down onto the floor and vice versa when coming from a sitting position to a lying position on the bed.

There is also a number of factors affecting the person to be helped that can have a negative effect. Such factors include, for example, the need to have a straight back during the manoeuvre from sitting to lying or vice versa, which can be hard to maintain without proper technique and/or equipment, also the need to have the patient's legs and upper body substantially parallel in the sagittal plane, which is hard to maintain without proper technique and/or equipment.

Shear of the skin may also be an issue for the person to be helped if no proper technique and/or equipment are used. The person to be helped may also be affected by the speed of the transition from sitting to lying or vice versa if it is not timed to the patient's conditions or preferences.

Another factor that can affect the person to be helped is the amount of activity that person contributes with throughout the manoeuvre. If the carer chooses to use a technique and/or equipment that makes the person to be helped more passive than necessary that will have a negative influence on that person's mobility level progression.

When the person helped has come from the lying position in bed to the sitting position at the edge of the bed, in many cases the person is also in need of help in the sit-to-stand sequence that generally follows.

An important factor of beds intended for persons in settings like elderly care facilities, special care clinics and hospitals or similar, is their ability to reach a very low position when the person is left unattended, preferable in order to minimize the consequences from an unintentional fall from the bed onto the floor. Another factor is the fact that a bed is a medical device which must meet regulations, and accessories not sanctioned by the manufacturer may not only hinder the bed's specified functionality but may also compromise the safety of the bed.

Not only are there personal gains in limiting the negative factors, there are also economical as all the negative factors have consequences that can be measured in economic terms, be it for the employer employing the carer having to reimburse the employee for conditions acquired due to lack of proper working technique and/or equipment provided or the prolonged rehabilitation of a patient that has been passivized.

Various known devices have sought to address the problem of a patient coming from a sitting position to a lying position at a bedside. For example, US 2004/0019967—"Assistance apparatus for assisting a person into and out of bed" discloses a device that the patient sits on and, while leaning onto the movable upper frame, their legs are elevated by the lower frame following the movement of the upper by the powered movement. Some drawbacks with the described device can be noted. It's design around a chassis intends it to be permanently installed adjacent the bed frame, which complicates use together with modern hospital beds that are height adjustable and have safety gates that need to be operable in the same area as the device occupies. With a chassis between the person's calves and the bed it will become even harder to come to the ideal position in the centre of the bed when lying down, since the starting position is further out than without a chassis adjacent to the bed. The person to be helped is also fully dependent on the apparatus in that it is powered in the motion, potentially leading to a more passivized person than needed.

Another device is disclosed in US 2010/0125947—"Leg Lifting Apparatus", where the person's legs are lifted onto the bed while sitting on the horizontal part of the bed. The device again mainly focuses on an independent person, this time having enough muscular tonus to handle the upper body movement personally. As the device is intended to be permanently mounted to the bed, it can be in conflict with the normal performance of the medical bed and can also be a hindrance to the following sit-to-stand movement if this is carried out with the help of a mobile device such as a sit-to-stand device having a chassis extending partly under the bed.

Yet another device is disclosed in U.S. Pat. No. 6,349,433 "Assembly of a bed and an apparatus for movement support for a person when moving into or out of a bed" where the person is helped with upper body movement by a lever.

Known devices, such as height adjustable beds, are a great help in providing an ergonomic workplace even with people of different length. Such beds are also known to have profiling features, in that they are able to raise the backrest helping the person come up to a more sitting position, and can minimize the physical demands of the carer. This sitting position is in the centre of the bed, facing towards the foot end of the bed and does not address the sometimes important need of having the legs and upper body parallel in the sagittal plane when coming from a lying position to a sitting position on the edge of the bed facing out from the beds longer side. Nor gives it any help in getting the legs up into the bed when going from a sitting position at the edge of the bed into a lying position. Another potential drawback is the fact that the speed of the backrest is fixed and does not adapt to the person's specific needs and/or preferences.

Patient lifters such as U.S. Pat. No. 6,557,189 may be able to minimize the load the carer is exposed to in the process of helping a person in coming from a lying position on a bed and up from the support surface, in that they are lifted in a sling with motorized help. The device may also re-position the person to a sitting position and deliver the person down to the edge of the bed. The biggest drawback of using this kind of device for this sort of manoeuvre is that the person helped out of the bed is forced to be very passive in this manoeuvre. Secondly, it is a very time consuming process.

The prior art devices can also have the drawback of being awkward to use with other patient transfer devices, such as a Sit-to-Stand device.

The present invention seeks to provide an improved patient repositioning device and method.

SUMMARY

According to an aspect of the present invention, there is provided a patient repositioning device for assisting in the movement of a patient, the device including a support unit provided with a generally planar upper body support coupled to a generally planar lower body support, the upper and lower body supports being substantially coplanar to one another and being laterally spaced form one another, and at least handle or grip coupled to the support unit and substantially rigid in a direction perpendicular to the plane of the upper and lower body supports.

Preferably, the support unit includes a lateral support coupled between the upper and lower body supports and separating the upper and lower body supports laterally. The lateral support may be an extension of one or both of the upper and lower body supports and may be in the form of a single or plurality of beams or a torsion spring.

Advantageously, the handle or grip provides torque transfer in at least two different directions.

In one embodiment, the handle or grip is rotatable between first and second orientations in a plane substantially parallel to the support unit.

In another embodiment the handle extends in at least two different directions in a plane substantially parallel to the plane of the support unit.

The handle may be integral with at least one of the body supports and the lateral support.

There may be provided a plurality of handles, which may be disposed at respective ones of the upper, lateral and lower supports.

In an embodiment, the handles are formed by apertures or slots in the supports or an enlarged head grip.

Preferably, there is also provided a patient grip. The patient grip may include a handle located on a strut, the handle extending at an angle to the plane of the support unit. The strut and patient handle preferably extend substantially perpendicular to the plane of the support unit.

In one embodiment there is provided a plurality of patient grip elements disposed at varying distances from the support unit. In another embodiment the patient grip is disposed on an extendable strut.

Preferably, the support unit is provided with rounded or resilient edges.

Advantageously, the upper body support and the lower body support are disposed at a shallow angle to one another; for instance a few degrees up to around 10 degrees or even up to around 20 degrees.

The lower body support may include an angled foot rest at a lower end thereof.

In some embodiments at least the body supports are curved or conformable to a curve. They may, for instance be curved to follow the curves of the side of a person or be of compressible or otherwise conformable material to be able to conform to the shape of the patient.

According to another aspect of the present invention, there is provided a patient cradle for assisting in the movement of a patient including an upper body support, a lower body support, a support yoke and at least one handle or grip on the yoke, the yoke allowing for cradling of a patient between a lying and an upright position.

The cradle preferably provides a space between the upper and lower body supports, allowing a patient to bend therebetween from a lying to a sitting position. Typically this is achieved by supporting the patient's torso and calves only.

The cradle preferably first and second handles or grips spaced from one another along the yoke. The or at least one of the grip or handle is located on the yoke in a patient balanced position.

Advantageously, there is provided at least one patient gripping element.

The preferred embodiments are able to address the various considerations for bringing a patient from a sitting to a lying position and vice versa and without the disadvantages of the prior art.

The herein disclosed devices can allow the caregiver to work in an ergonomically good way with the manoeuvres required to help a person coming from a lying position in bed to a sitting position at the longer edge of the same bed and vice versa while maintaining the helped person maintain their legs and upper body generally parallel in the sagittal plane throughout the manoeuvre. As it allows for the person to be helped to contribute as much or as little as achievable, it does not contribute to the patient being passivized. The caregiver can also adapt the speed of the manoeuvre to the given situation, in that the device is manoeuvred preferably by hand and in direct contact with the person to be helped. The device allows the caregiver to position the person in the middle of the bed after the legs have been lifted up onto the bed and the upper body laid down onto the bed, without the need to reach and/or bend her body excessively in that the device extends the care giver's working range. As the preferred device is portable and only temporarily used at the bed it also facilitates the pre- and post-activities and the use of other equipment, for example a Sit-to-Stand device, in that it does not remain in the way of those other devices. This also ensures that the bed can be used as originally specified and without compromising any safety related aspects of it.

As the preferred apparatus is non-powered, lightweight, portable, easy to understand, one size and designed to have a low manufacturing cost, it is expected to have a good impact on the working conditions of care givers, on patient outcome and health economics.

The preferred device can work as a see-saw, where the person to be laid down sits on the longer edge of a bed's horizontal part and, leaning their left or right side with legs dangling off the side of the bed, positions their upper body to the upper part of the device and their legs to the lower part of the device, with their legs and upper body generally parallel in the sagittal plane. While the caregiver holds the device in the correct place against the person to be laid down, by means of at least one handle on the device to hold onto, the caregiver initializes the movement by tilting the device towards the side on which the person to be helped is going to have their head when lying down. The person to be laid down follows the movement and the heavier upper body brings a positive torque or moment to the device driving her legs up in the same movement given that the device is predominately rigidly connected between its upper and lower parts. The caregiver can moderate the speed of the movement by adding a counteracting torque or force to the device, specifically applying force in opposite direction to the rotation. When the person lies down with their upper body parallel to the bed's horizontal support surface. the second stage is initialized by the caregiver, by holding onto the leg part of the device and tilting this away. This enables the patient to be shifted from the sagittal plane in a predominately horizontal position into a predominately vertical position and by that comes from a position mainly close to the longer edge of the bed into mainly the centre part of the bed, now on their back with slightly bent legs. In this position the person can be brought to a complete lying position by straightening out the patient's legs, either by themselves or with help from the caregiver after the caregiver has removed the device from the close proximity of the patient.

The reverse workflow will bring a person who is lying down on the bed to a sitting position at the longer edge of the bed's horizontal part. The reverse workflow has one main difference, in that as the upper body of the person to come into a sitting position is heavier than the legs, the caregiver will have to apply a greater force of torque to the device when rotating the person from the lying to the sitting position as compared to the reverse manoeuvre.

Another way of operating the device can be achieved by incorporating the functionality of some beds having a power adjustable back-rest, letting the bed's power adjustable back-rest add the required force or torque when rotating the person from the lying to the sitting position or vice versa. In this way the caregiver just need to apply sufficient force for guiding the device through this sequence.

Yet another way of operating the device can be achieved by the caregiver instructing the person to be seated to add the required force or torque by pressing away from the bed with one hand and at the same time holding onto the device with the other hand. In this way the caregiver just needs to apply sufficient force for guiding the device through this sequence.

Nurse benefits include: reducing unsafe manual handling and not having to bend down and lift heavy legs in to bed.

Patient benefits include: a more gentle way of lying down on to bed since the twisting between the upper and lower body is eliminated in the movement from sitting to lying.

Thus, the preferred apparatus allows a care giver to reposition a person, for example and hereafter called a patient, from a sitting position on the edge of the bed frame to a lying position on the bed with minimal effort. The patient sits on the edge of the bed frame facing out from the longest side of the bed, while she is leaning her upper body to the side, towards the upper part of the apparatus, the apparatus, while guided by the care giver, lifts her legs up in a way that her body, seen from front, forms a predominantly straight line during the movement of her upper body towards a lying position on the horizontal bed frame top.

As the patient to be repositioned is supported by the disclosed apparatus for the upper body as well as for the legs, the loads on muscles are minimized, as are pain. Not only the patient gains from this apparatus, as it is a significant source for back pain for care givers helping patients onto beds, where getting the feet up from the floor onto the bed puts a lot of strain on their back. Care givers will be able to assist patients in a much more ergonomically correct position with the help of this apparatus and technique.

The herein disclosed apparatus can also allow the caregiver, in an intuitive way, to help a patient to get to their feet up onto a bed without any need for electrically manoeuvred apparatus. Also the apparatus can allow usage of additional patient transfer devices in that it will be out of the way from the area in front and under the bed which traditionally are used by patient transfer devices such as Sit-to-Stand devices.

BRIEF DESCRIPTION OF THE DRAWINGS

Embodiments of the present invention are described below, by way of example only, with reference to the accompanying drawings, in which.

DETAILED DESCRIPTION

Figure 1:
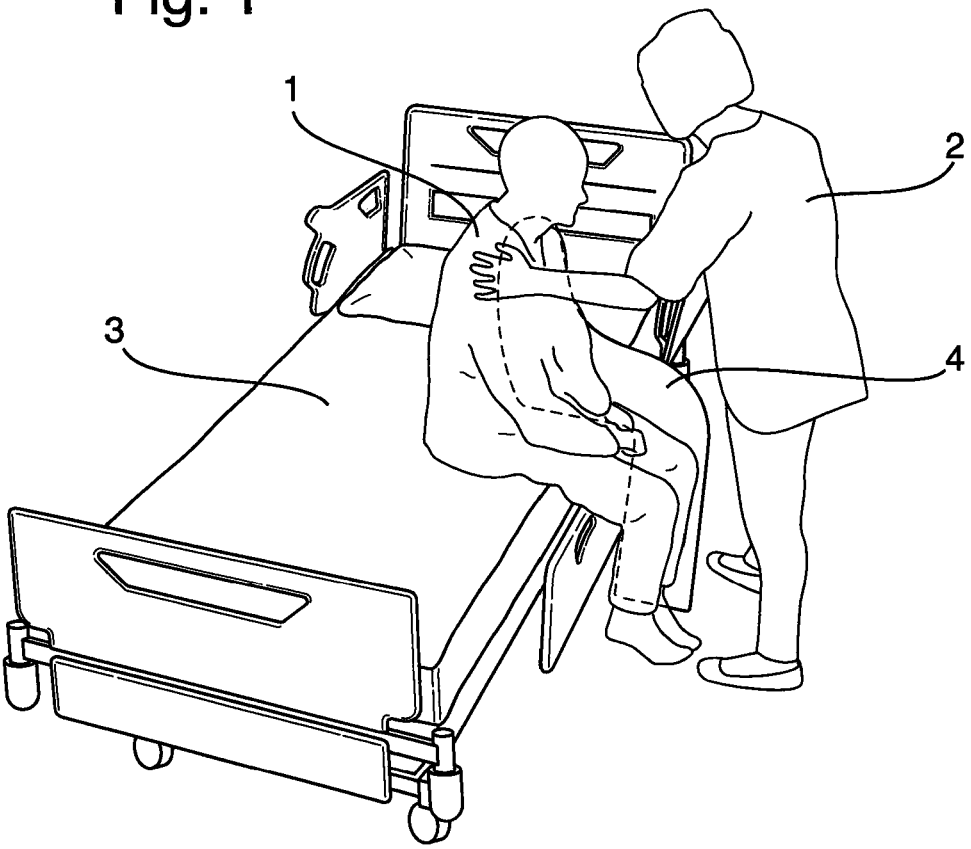
FIGS. 1 to 5 show in schematic form a sequence of placing a patient onto a bed by means of an embodiment of patient repositioning system as taught herein.

Referring to FIG. 1 is shown the predominately horizontal surface (3) of a bed hereinafter the top. The illustration shows a hospital bed but it is to be understood that it could also represent a couch, a stretcher, an examination table, an operation table or any other surface that a person normally would sit on to before lying down onto the same. The patient's (1) starting position is sitting on the longer edge of the top of the surface (3) prior to lying down, facing upwards. The care giver (2) places the mobile patient support (4) adjacent one side of the patient (1), specifically on the same side of the patient (1) as the patient (1) is to lean in order to reach the final lying position on the top (3) of the bed. The contact surface of patient support (4) is preferably made of a material and structure that gives comfort to the patient (1), for example but not limited to, polypropylene, wood, polyurethane, combinations of these or any other suitable materials. The contact surface of the support (4) may be padded for added comfort and/or slightly curved.

Figure 2:
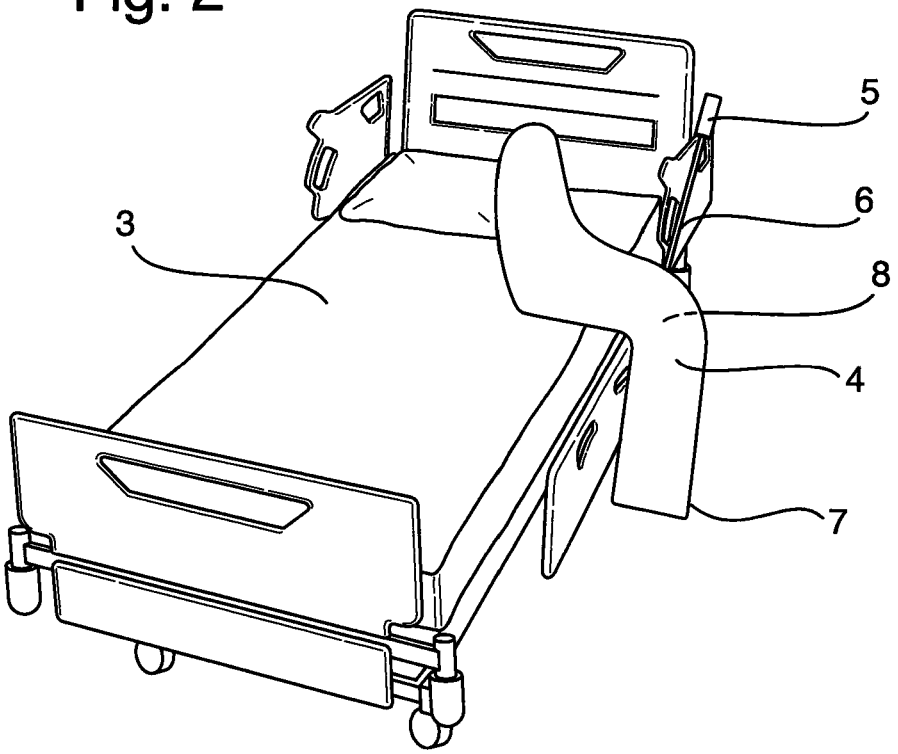
Figure 6:
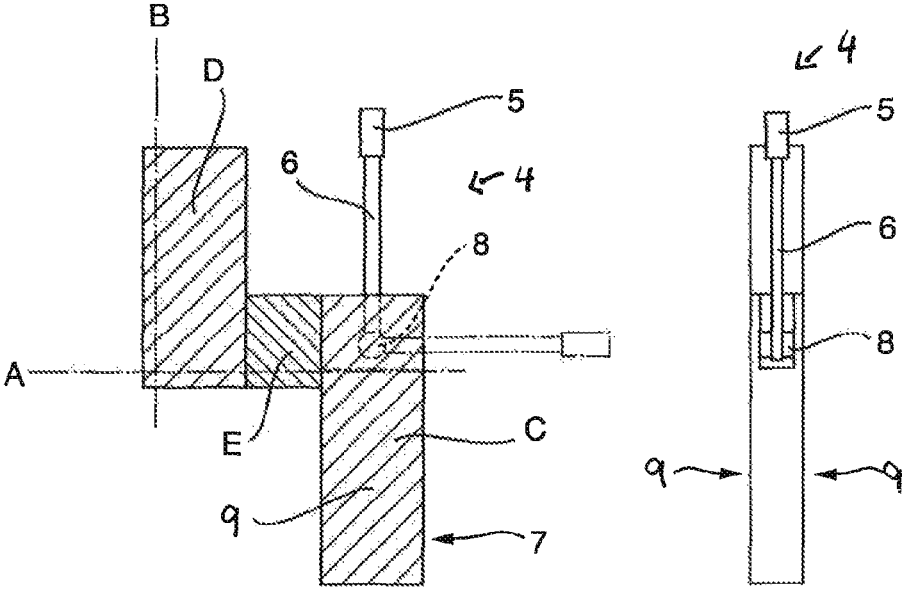
FIG. 6 shows front and side elevational views in schematic form of a handle for the patient repositioning system of FIGS. 1 to 5.

Referring to FIGS. 2 and 6, there is shown the apparatus prior to positioning by a patient. AS can be seen, the apparatus includes means for the care giver (2) to hold onto, in this embodiment being in the form of a handle (5) securely connected by an arm (6) to a coupling or pivot point (8) which allows rotation around an axis predominately perpendicular to the patient contact surface (9), allowing the handle (5) and arm (6) to be positioned predominately parallel to the edge (7) of the patient contact surface (9) or predominately perpendicular to the edge (7) of the patient contact surface (9) or at any angle in between. The arrangement with the rotatable coupling point (8), the arm (6) and the handle (5) provides a lever for the care giver (2) to aid in the task of tilting around axis A and respectively axis B as shown in FIG. 6.

Referring to FIG. 6 the patient support (4) has a portion (C) shaped and sized to support the legs of a patient (1) and a portion (D) shaped and sized to support the upper body of the patient (1). Portion (D) is preferably generally parallel with portion (C) and most preferably substantially coplanar. The two portions (C) and (D) may be separated, if found suitable, by a lateral portion (E) providing lateral separation of portions (C) and (D). Portion (E) may be an extension of portion (C) or (D) or both, but could also be in the form of, for example but not limited to, a single or plurality of beams, a torsion spring with sufficient force to enable the function of the apparatus as described before.

The patient support surface (9) may be flat or given a shape conforming or conformable to the shape of the side of a patient (1) which it is intended to support. Preferably, the patient support surface (9) is equivalent on both sides of the apparatus, giving it a longitudinal symmetrical appearance, illustrated by the two opposite facing patient supporting surfaces (9) in FIG. 6, thus to enable the apparatus to be used from either side of a patient (1), thereby to aid in getting into a bed from one side or the other.

Figure 7:
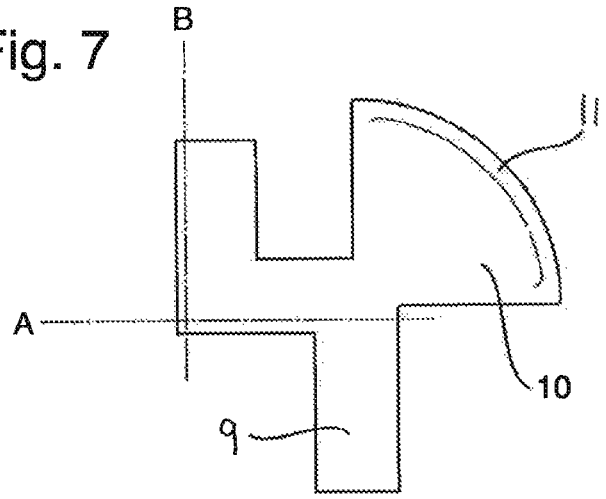
FIG. 7 shows front and side elevational views in schematic form of another handle for the patient repositioning system of FIGS. 1 to 5.

It is to be understood that the arrangement with the rotatable coupling point (8), the arm (6) and the handle (5) could be designed in other ways while still aiding the care giver (2) in the task of tilting around axis A and respectively axis B in the manner depicted in FIG. 6. One such configuration is shown in FIG. 7 where an edge profile (11) is rigidly connected via a connecting portion (10) with the patient contact surface (9), thus providing a lever for the care giver (2) to aid in the task of tilting around axis A and respectively axis B.

Figure 3:
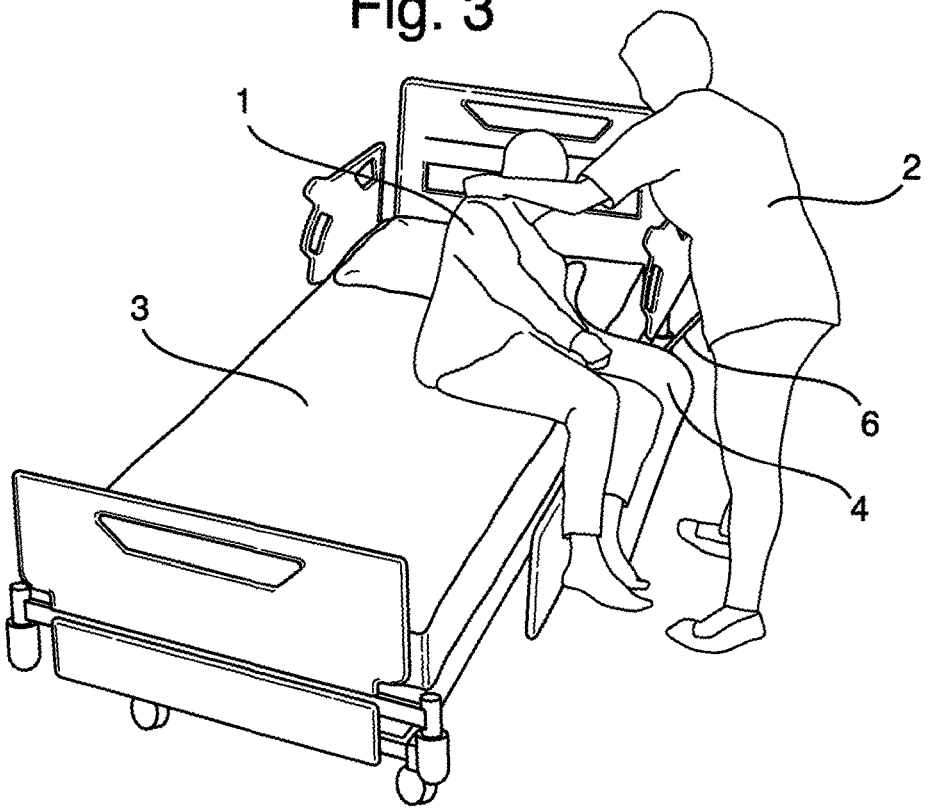

Referring now to FIG. 3 the care giver (2) gently guides the patient (1) to lean with their upper body against the patient support surface (9) of the mobile patient support (4), causing it to tilt about axis A. The weight of the patient's (1) upper body onto the upper part of the patient support surface (9), together with assistance from the care giver (2) applying force on the handle (5), rotates the lower part of the patient support surface (9) about axis A and causes the patient's (1) legs to rise from a predominately vertical position towards a predominately horizontal position parallel to the surface (3) of the bed.

Figure 4:
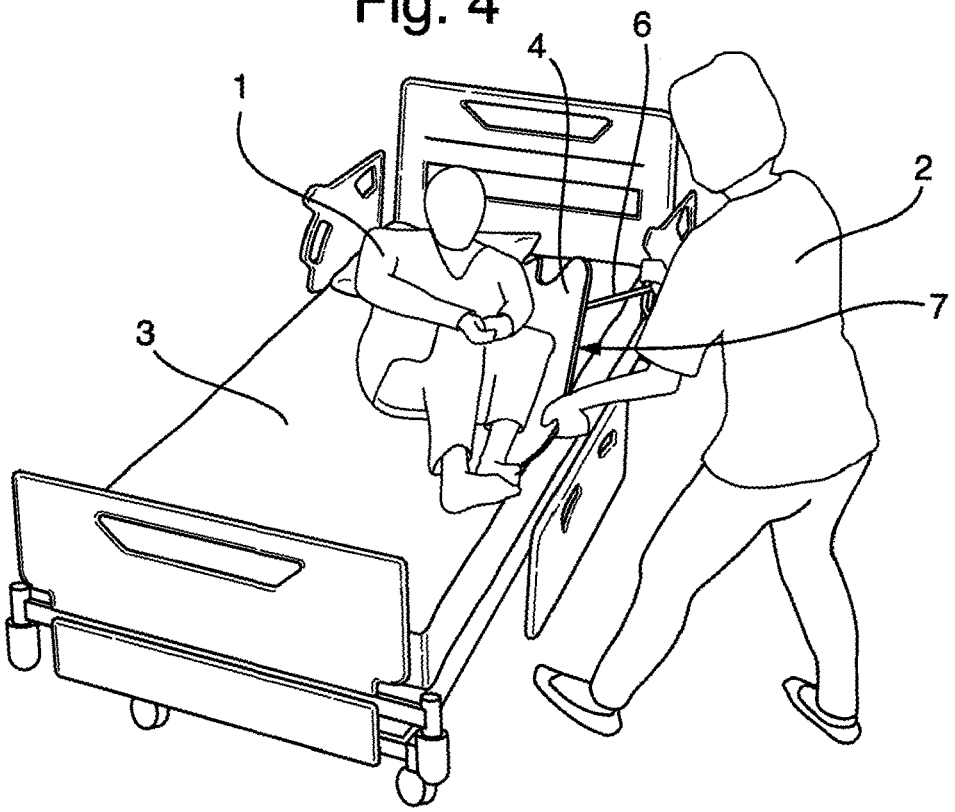
Figure 5:
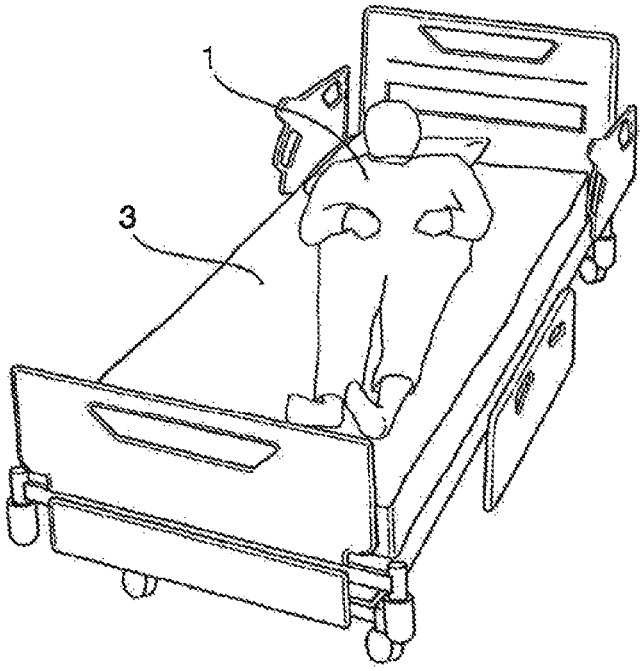

Referring to FIG. 4 the care giver (2) then alters the position of the handle (5) from being predominately parallel to the edge (7) to being predominately perpendicular to the edge (7) in order to provide a lever aiding in in the task of rotating the patient support surface (9) about axis B so as to position the patient's (1) back against the surface (3) of the bed, along with the patient's (1) feet as illustrated in FIG. 5.

Another embodiment of patient repositioning support is shown in FIGS. 8 to 12.

Figure 8:
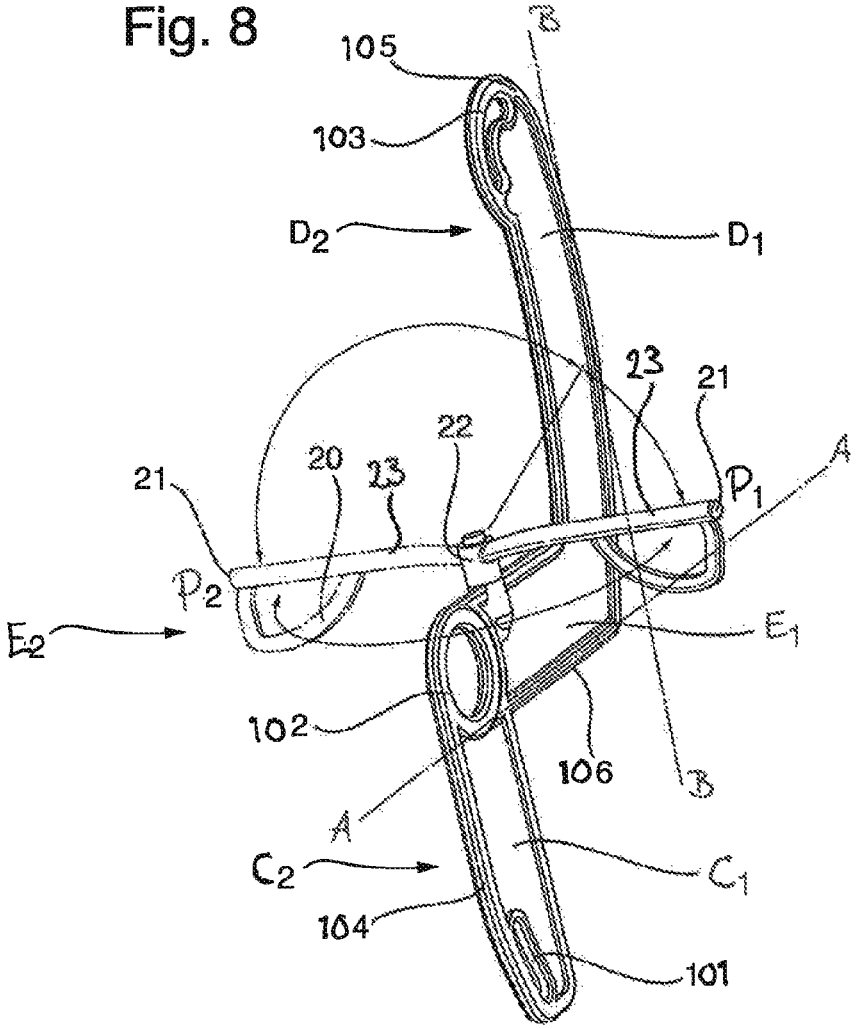
FIGS. 8 and 9 show another embodiment of patient repositioning system.

Referring first to FIG. 8, the device includes a portion C1 shaped and sized to support the legs of the person or patient to be helped, wherein the portion C1 is substantially parallel to a portion D1 sized and shaped to support the upper body of the patient. The two portions C1 and D1 are preferably laterally separated to approximately fit the silhouette of an sitting person seen in the sagittal plane. In this regard, a lateral portion E1 which connects the portions C1 and D1 may be an extension of area C1 or D1 or both, but could also be in the form of, for example but not limited to, a single or plurality of beams, a torsional spring with sufficient rigidity to enable the function of the apparatus as described before.

Figure 10:
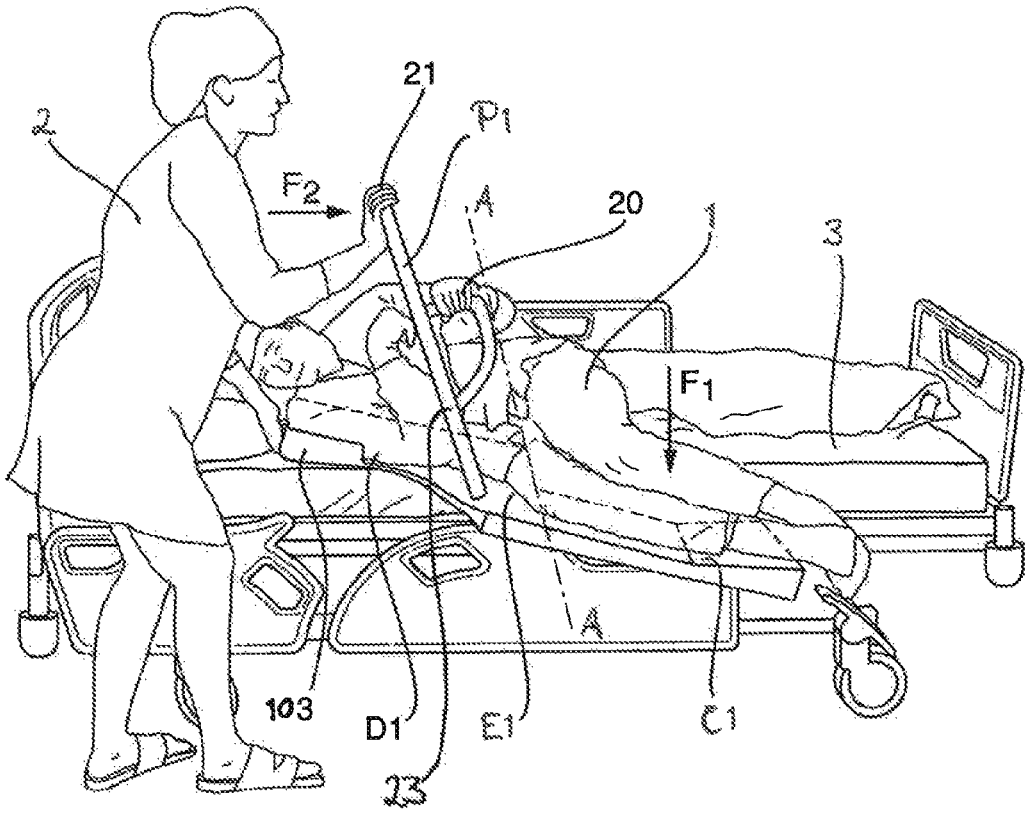
FIGS. 10 to 12 show in schematic form a sequence of placing a patient onto a bed by means of the patient repositioning system of FIGS. 8 and 9.

The patient support surface portions C1, D1 and E1 may be flat or have a shape to conforming or conformable to the patient's body. For example, the outmost part or side of the portion C1 near the patient's feet could be slightly inclined as shown in FIG. 10. Preferably the patient support portions C1, D1 and E1 have symmetrically opposing sides surfaces C2, D2 and E2 to be enable the device to be used from either side, thus enabling the single device to be used at a bed from one side or the other.

As the device's contact surfaces C1/C2, D1/D2 and E1/E2 are designed to be in close contact to the patient's body, they are preferably made of a material and/or structure that gives comfort to the patient, for example but not limited to, polypropylene, wood, polyurethane, combinations of them or any other suitable materials characterized in being rigid enough to support the weight of the upper body and legs of the patient yet comfortable. They may have a soft covering.

The device is intended to be rotated about the predominately horizontal axis A-A when bringing the patient from a lying to a sitting position or vice versa. Preferably the device includes gripping means which in this example is in from of one or several handles 103 located at or proximate the edge 105 of patient support portion D1/D2. The handle/s may be in the form of aperture/s in the support portion D1/D2, the edge 105 forming a handgrip that is suitable to grip around by the person helping the patient. Preferably, the handle 103 is located a distance from the axis A-A to form a lever to minimize the force needed to be applied by the caregiver to bring the patient from a lying position into a sitting position and in the same time being suitable for the range of motion of the caregiver.

Figure 9:
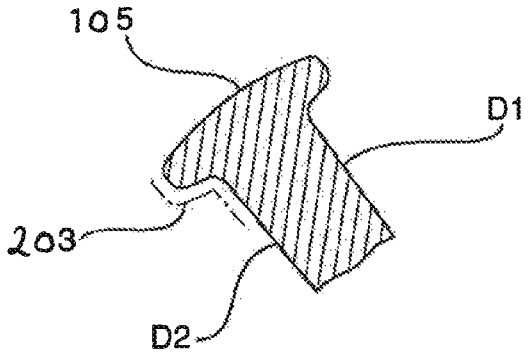

Another example of grip forms the edge 105 itself into a grip as seen in FIG. 9, where the edge 105 has an enlarged head 203 facilitating grip of the fingers of the caregiver to the device. The described examples are not limiting, several other ways of providing suitable grips may be realized by the skilled person, for example but not limited to, ropes and or webbing attached to the device, spherical formed extensions from the portion D1/D2, etc.

To bring the device in rotation around the axis A-A, yet another point of grip 21 is preferably provided. The grip point 21 is preferably located spaced from the first handle/s 103 in order for the caregiver to be able to use both hands to add force contributing to the rotational movement and having a distance from the axis A-A to form a lever arm 23 to minimize the force needed to be applied by the caregiver to bring the patient from a lying position into a sitting position and in the same time being suitable for the range of motion of the caregiver. Preferably, the grip point 21 is located somewhere along a strut extending from the portion E1/E2 and not parallel to portion E1/E2. To provide a grip point 21 having a suitable distance from the axis A-A to suit different caregivers statute or different patient weights, the strut may be telescopic or provided with a multitude of grip points 21. Along the strut and preferably between the grip point 21 and the portions C1, E1 there is preferably provided a place or handle 20 for the patient to hold onto. Preferably the handle 20 is formed to accommodate at least one of the patient's hands, thereby enabling the patient to hold onto the device.

To enable a single device to be used at a bed from one side or the other, the lever arm 23 preferably has two mirror inverted positions about a plane parallel to the portions C1, D1 and E1, illustrated by the first position P1 and the second mirror inverted position P2. The lever arm 23 is rotatably or flexibly attached to the device by a joint 22 allowing it to move between the two positions P1 and P2, with reference to a plane perpendicular to the axis A-A. The movement may take a path parallel to this plane or a path perpendicular to this, or any other path in between the two. Preferably, the pivotable or flexible joint 22 may transform into a rigid joint when desired or have two end positions characterized by the lever arm 23 being supported by said end position to work as a lever when applying force to the engagement point 21 to bring the device in rotation around axis A-A. In one of several possible embodiments, the joint 22 may be adjusted from a rotatable or flexible configuration to a rigid configuration by actuation of a locking pin on lever arm 23, passing into a corresponding recess in joint 22. In another embodiment the flexible joint 22 may be adjusted from a rotatable or flexible configuration to a rigid configuration by application of a force on the lever arm 23 exceeding a holding force in the joint 22, the holding force in joint 22 resulting from, for example friction, a spring loaded ratchet mechanism or similar device. The proposed embodiments of the joint 22 just serve as examples and several other ways of providing suitable solutions will be apparent to the skilled person having regard to the teachings herein.

When a patient is to be brought in rotation around the transverse plane, that is to be rotated when sitting or lying near the edge of the longer side of the supporting surface of a bed towards the middle of the bed, the device is able to rotate around the predominately horizontal axis B-B. To facilitate this, the device preferably also includes gripping means in from of one or several handles 101, 102 about the edge 104 of patient support portion C1/C2. The handle/s may be in the form of aperture/s in the support portion C1/C2 in that the edge 104 forms a shape that is suitable to grip around by the caregivers. Preferably, the handle/s 101, 102 are located a distance from the axis B-B to form a lever to minimize the force needed to be applied by the caregiver to rotate the patient about the transverse plane.

The edge or edges 106 of the device are designed to cooperate with the support surface of the mating equipment, in this example the mattress of a bed, without damage to the surface. In one embodiment, the edge or edges 106 may be made of a flexible material, for example but not limited to, polyurethane, neoprene or hollow formed polypropylene. In another embodiment the edge or edges 106 may be predominately stiff and given a rounded shape. The proposed embodiments of the edge or edges 106 just serve as examples, as several other ways of providing suitable solutions will be apparent to the skilled person having regard to the teachings herein.

Referring now to FIG. 10, the device is shown aiding a person, the patient 1, from a lying position to a sitting position. The patient's body is in contact with the device in that the upper body resting on the device portion D1, the legs rest on portion C1 and the patient's pelvis rests on portion E1. When lying down the portion D1 and the patient's upper body are supported by the predominately horizontal surface 3 of the bed. The illustration shows a hospital bed but it is to be understood that it could also represent a couch, a stretcher, an examination table, an operation table or any other surface that a person normally would rest upon. The patient's legs are supported by the device portion C1, both being outside the horizontal support surface 3 ready to raise the patient and would typically also be the case when the patient is being moved from a sitting position to a reclining position. The portion E1 is stiff enough to keep the patient's 1 legs and upper body substantially parallel in the sagittal plane and the device will not introduce any unwanted twisting on the patient's body. For the patient 1 to feel safe and secure the patient 1 can hold onto the handle 20, which is at least rigid in the direction towards and away from the patient 1 when the patient 1 is in contact with the surfaces C1, D1 and E1 or C2, D2 and E2.

To bring the patient 1 from the lying position to a sitting position the device is rotated around the axis A-A. Since the upper body of the patient in most cases is heavier than the legs, an assistive force is applied to rotate the device and patient 1 upwardly. The device will function as a see-saw rotating around the portion E1/2 and the pelvis of the patient 1, both supported by the surface 3, with the legs of the patient 1 contributing with force F1. The caregiver 2 will contribute a force F2 to bring the device and the patient up to a sitting position. The caregiver 2 can apply the force F2 at a single position or at multiple positions, where the force F2 will be divided into multiple lower forces. The force F2 will be inversely proportional to the distance to the axis A-A. For this purpose, preferably the caregiver 2 uses the grip point 21 which is rigidly connected to portion E1/2 and further uses the handle 103 which is spaced from the first grip point 21 and still provides a long enough lever relative to the axis A-A and at the same time provides a convenient grip for operation. The structure enables the caregiver 2 to steer the device manually while remaining in close contact with the patient 1, thereby being able to observe and attend to the needs of the patient 1 and regulate the speed of operation. Another way to apply the force F2 can be realized with beds that have articulated support surfaces 3, in that the backrest raise function may be activated to bring the device in rotation around axis A-A. In such an event, the caregiver 30 can aid in the rotation of the device by holding on to it via any of the provided support points, for example 21 and/or 103, giving it stability and being ready to add needed force and range of rotation motion as the articulated support surfaces 3 of the backrest will not necessarily have the range of motion needed for a complete transfer to a sitting position of the patient 1.

When the device have been rotated, typically a quarter of a turn around the axis A-A, by the weight of the patient's legs and the aid from the caregiver and/or the aid of the articulated frame of the bed, the patient 1 will come to a sitting position on the edge of the support surface 3. In this position the caregiver 2 may effortlessly remove the device after ensuring the patient 1 has released their optional grip on the handle 20. Once the device have been removed from contact with the patient 1 and is no longer in close proximity to the bed, there will no longer be any additional device at the bed hindering integration with other activities or medical equipment.

The procedure to go from a sitting position to a lying position is the reverse of the above described procedure.

Figure 11:
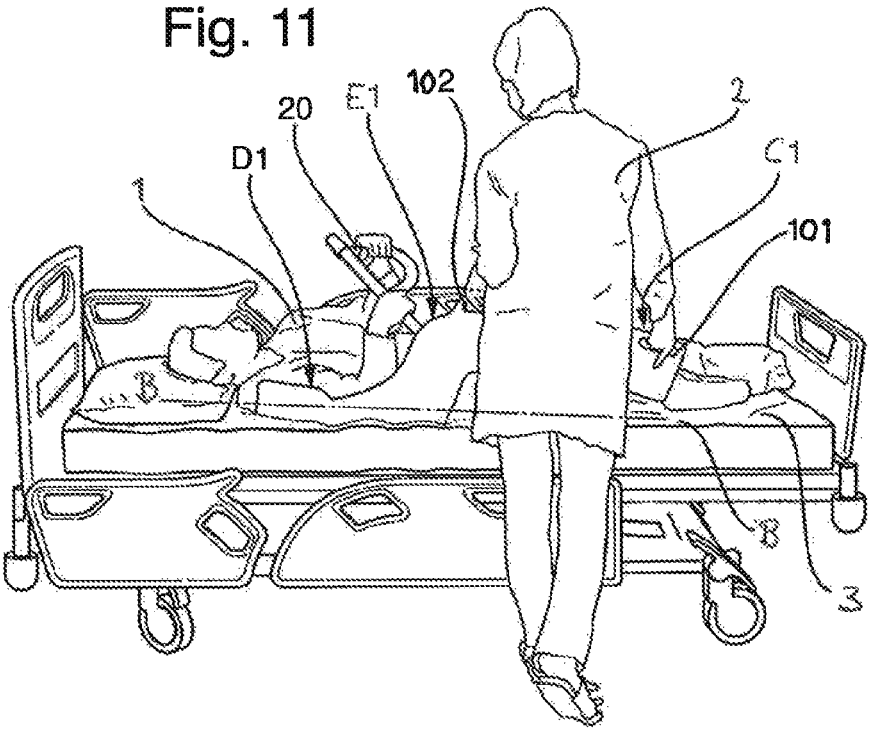

Referring to FIG. 11 the device can be used for displacing a patient 1 from a lying position near the longer edge of the support surface 3 into a more central position of the support surface 3 and onto their back while maintaining her legs and upper body parallel in the sagittal plane. By tilting the device around the axis B-B away from the caregiver 2 the patient 1 rolls over onto their by being pushed by the portions C1, D1 and E1. Preferably, the caregiver 2 will hold onto the device in one or several positions, by example there may be a handle 102 for the left hand and a handle 101 for the right hand, while the patient 1 can hold onto the provided handle 20. As the caregiver 2 will typically manually steer the device in close contact with the patient 1, the care giver 2 is able to adjust the speed and force of movement to the needs of the patient 1 when performing the manoeuvre. When the patient 1 has been turned to their back and has released their grip of the handle 20, the caregiver 2 can remove the device. The support surface 3 and bed-frame are then free from the device, allowing it to be used as intended without interference by the device.

Figure 12:
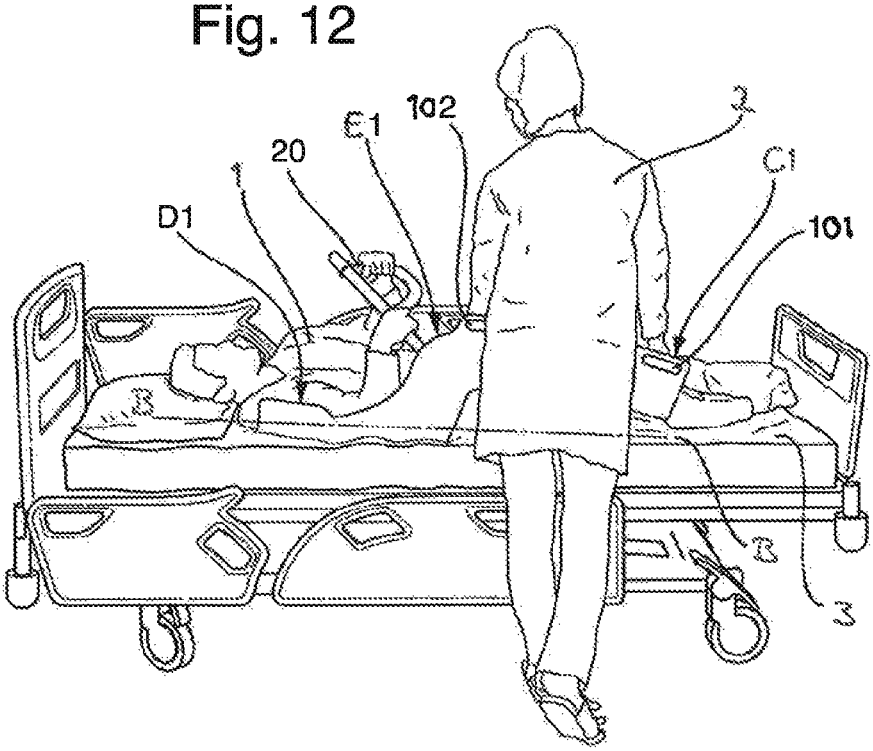

Referring to FIG. 12 the device can also be used for displacing the patient 1 from a predominately central position of the support surface 3 lying onto their back onto their side near the longer edge of the support surface 3, ready to be transferred to a sitting position by aid of the device and the caregiver 2. To maintain the legs and upper body parallel in the sagittal plane the caregiver 2 places the device into close contact to the patient's 1 body and such that the patient's shoulder abuts surface D1, the hip abuts surface E1 and the knees abut surface C1, or C2, D2 and E2 depending on side of the bed. In order for the knees to abut surface C1 they may need to be raised up from the support surface 3. Preferably the caregiver 2 will aid the patient 1 in this manoeuvre by raising the patient's knees while at the same time guiding the patient's feet along the support surface 3 to minimize friction. The patient 1 may be told or guided by the caregiver 2 to hold onto the handle 20 with at least one hand. The device and the patient 1 are then tilted around the axis B-B towards the caregiver 2 with the caregiver 2 holding onto the patient 1, gently pressing the patient against the device. The caregiver 2 can at any moment, as the situation dictates, shift one or both of the patient's points of contact to another or any suitable point on the device, preferably any of the provided grips, for example grip 101 to guide the device and the patient. As that the caregiver 2 manually steers the device in close contact with the patient 1, the caregiver she is able to adjust the speed and force of the movement to the needs of the patient 1 when performing the manoeuvre. When the patient 1 and the device have rotated approximately a quarter of a turn around the axis B-B the patient 1 comes to a lying position partly supported by the device portions C1, D1 and E1 and partly by the support surface 3, ready to be brought into a sitting position as described in earlier sections.

Figure 13:
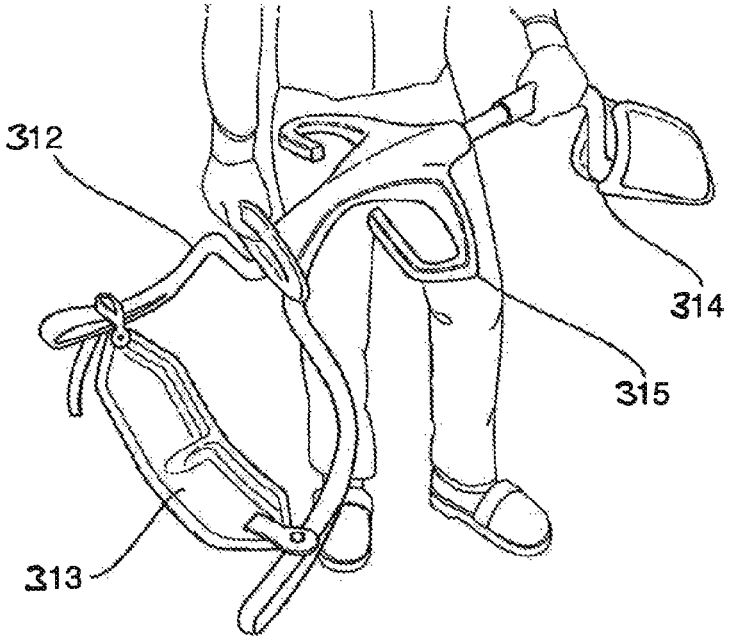
FIGS. 13 to 15 show an embodiment of patient cradle.
Figure 14:
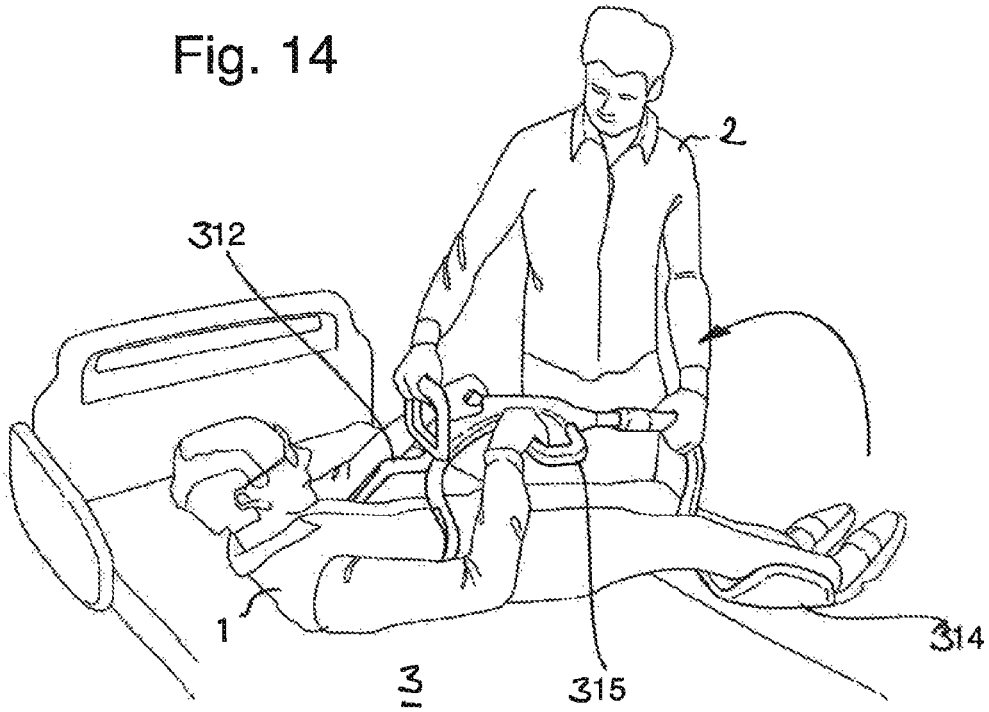
Figure 15:
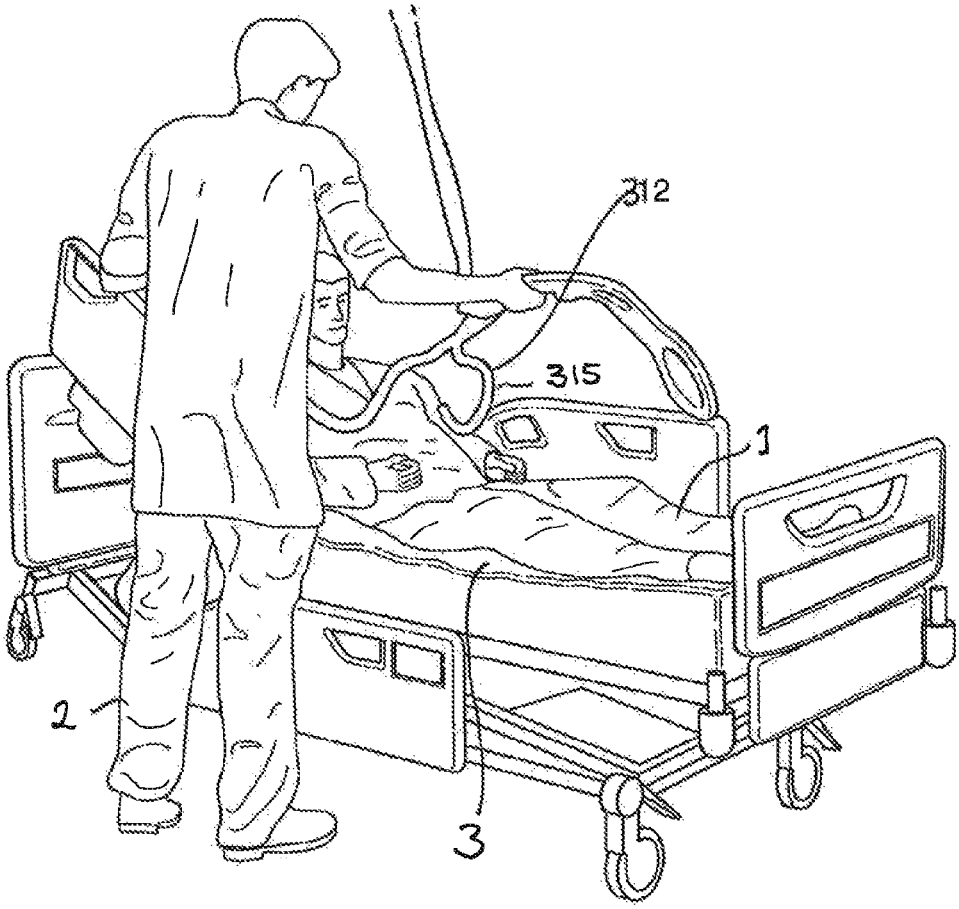

Another method of helping a patient to get to their feet is by using a see-saw device 312 as shown in FIGS. 13 and 14. The device can also be used in combination with a ceiling lift (not shown) as shown in FIG. 15.

As seen in these Figures, the device (312) is placed in front of the patient 1 with a sling (313) to support the back. The lower end (314) is placed under the patient's legs and the patient 1 is asked to grip the handles (315) midway of the device. The carer 2 (FIG. 13) or the ceiling lift (FIG. 15) is then able to position the patient to lie down on the bed or vice versa. The patient 1 will rock or cradle between the lying and upright positions.

All optional and preferred features and modifications of the described embodiments and dependent claims are usable in all aspects of the invention taught herein. Furthermore, the individual features of the dependent claims, as well as all optional and preferred features and modifications of the described embodiments are combinable and interchangeable with one another.

REFERENCE SIGNS

1 patient
2 caregiver
3 horizontal surface of a bed
4 mobile patient support device
5 handle
6 arm
7 edge of the patient contact surface 9
8 pivot point
9 patient contact surface
A axis
B axis
C, C1, C2 portion for supporting the legs
D, D1, D2 portion for supporting the upper body
E, E1, E2 lateral portion
10 connecting portion
11 edge profile
20 handle for patient to hold onto
21 point of grip
22 joint
23 lever arm
101 handle
102 handle
103 handle
104 edge of C1/C2
105 edge of D1/D2
106 edge of the device
203 enlarged head
P1 first position
P2 second position
312 seesaw device
313 sling
314 lower end
315 handles

The invention claimed is:

1. A patient repositioning device for assisting in the movement of a patient around at least a first axis, the device including a support unit provided with a generally planar upper body support, for supporting an upper body of the patient, a generally planar lower body support, for supporting a lower body of the patient, a lateral support coupled between the upper and lower body supports and separating the upper and lower body supports laterally from one another, the upper body support, lower body support, and lateral support being substantially coplanar to one another to define at least one continuous patient supporting surface, and a grip handle coupled to the support unit at a rotatable coupling point of the lower body support to position the grip handle to be one of: a) a first position so as to be substantially rigid in a first direction perpendicular to the plane of the upper and lower body supports; b) a second position so as to be substantially rigid in a direction relative to the plane of the upper and lower body supports; and/or c) a third position between the first and second positions, wherein the grip handle can be used to tilt the support unit around the first axis of the device to position the patient, wherein a weight of the patient acting on the upper body support aids a user in tilting the support unit around the first axis from a sitting position toward a lying position, and wherein the weight of the patient acting on the lower body support aids the user in tilting the support unit around the first axis from a lying position toward a sitting position, and wherein the grip handle extends in at least two different directions in a plane substantially parallel to a plane of the support unit.

2. A patient repositioning device according to claim 1, wherein the lateral support is an extension of one or both of the upper and lower body supports.

3. A patient repositioning device according to claim 1, wherein the lateral support is in the form of a single or plurality of beams or a torsion spring.

4. A patient repositioning device according to claim 1, wherein the handle or grip can be positioned to allow for torque transfer in at least two different directions.

5. A patient repositioning device according to claim 1, wherein the handle or grip is integral with the lower body support.

6. A patient repositioning device according to claim 1, including a plurality of handles.

7. A patient repositioning device according to claim 6, wherein the plurality of handles are disposed at respective ones of the upper, lateral and lower supports.

8. A patient repositioning device according to claim 6, wherein the handles are formed by apertures or slots in the supports or an enlarged head grip.

9. A patient repositioning device according to claim 1, including a patient grip.

10. A patient repositioning device according to claim 9, wherein the patient grip includes a handle located on a strut, the handle extending at an angle to the plane of the support unit.

11. A patient repositioning device according to claim 10, wherein the strut and patient handle extend substantially perpendicular to the plane of the support unit.

12. A patient repositioning device according to claim 9, including a plurality of patient grip elements disposed at varying distances from the support unit.

13. A patient repositioning device according to any one of claim 9, wherein the patient grip is disposed on an extendable strut.

14. A patient repositioning device according to claim 1, wherein the support unit is provided with rounded or resilient edges.

15. A patient repositioning device according to claim 1, wherein the lower body support includes an angled foot rest at a lower end thereof.

16. A patient repositioning device according to claim 1, wherein the body supports are curved or conformable to a curve.

17. The patient repositioning device according to claim 1, wherein the at least one continuous patient supporting surface comprises a first patient supporting surface on a first side of the support unit and a second patient supporting surface on a second side of the support unit, the first patient supporting surface and the second patient supporting surface enabling the support unit to be used from either side of the patient.

18. A patient repositioning device for assisting in the movement of a patient around at least one of a first axis and a second axis of the device, the device comprising:

a generally planar upper body support for supporting an upper body of the patient;

a generally planar lower body support that extends from the generally planar upper body support and supports a lower body of the patient;

a lateral portion laterally spacing the upper body support and lower body support from one another, wherein the upper body support, lower body support, and lateral portion are substantially coplanar to one another to define at least one continuous patient supporting surface; and at least one handle pivotably coupled to a body of the device at a rotatable coupling point of the lower body support to position the handle to be one of: a) a first position so as to be substantially rigid in a first direction perpendicular to the plane of the upper and lower body supports; and/or b) a second position so as to be substantially rigid in a second direction relative to the plane of the upper and lower body supports such that the grip or handle can be used to tilt the device around a first axis to position the patient and wherein the device may be tilted around a second axis to position a patient, wherein the device is non-motorized, wherein a weight of the patient acting on the upper body support aids a user in tilting the device around the first axis from a sitting position toward a lying position, wherein the weight of the patient acting on the lower body support aids the user in tilting the device around the first axis from the lying position toward the sitting position, and wherein the handle extends in at least two different directions in a plane substantially parallel to the plane of the support unit.

19. A patient repositioning device according to claim 18, wherein the weight of the patient aids a user in tilting the device around the second axis.

20. The patient repositioning device according to claim 18, wherein the at least one continuous patient supporting surface comprises a first patient supporting surface on a first side of the patient repositioning device and a second patient supporting surface on a second side of the patient repositioning device, the first patient supporting surface and the second patient supporting surface enabling the patient repositioning device to be used from either side of the patient.

21. A patient repositioning device for assisting in the movement of a patient between a supine position and a seated position, the device comprising:

a substantially planar upper body support for supporting an upper body of the patient;

a substantially planar lower body support that extends from the substantially planar upper body support and supports a lower body of the patient, wherein the upper and lower body supports are substantially coplanar to define at least one continuous patient supporting surface; and a handle pivotably coupled to the lower body support to allow for selective positioning of the handle for use as a lever for tilting the device;

wherein a weight of the patient aids a user in tilting the device to facilitate moving a patient between a supine and a seated position, wherein the weight of the patient aids the user in tilting the device to facilitate moving the patient between the seated position and the supine position, wherein the device is non-motorized, and wherein the handle extends in at least two different directions in a plane substantially parallel to a plane of the upper and lower body supports.

22. The patient repositioning device according to claim 21, wherein the at least one continuous patient supporting surface comprises a first patient supporting surface on a first side of the patient repositioning device and a second patient supporting surface on a second side of the patient repositioning device, the first patient supporting surface and the second patient supporting surface enabling the patient repositioning device to be used from either side of the patient.

* * * * *